US008935937B2

(12) United States Patent
Godbout et al.

(10) Patent No.: US 8,935,937 B2
(45) Date of Patent: Jan. 20, 2015

(54) AIR CONDITIONER TURBULENCE CREATING ENERGY SAVER

(75) Inventors: Gerard Alfred Godbout, Ottawa (CA); Debra Anne Claire Godbout, Ottawa (CA)

(73) Assignee: Vairtex Canada Inc., Ottawa, Ontario (CA)

( * ) Notice: Subject to any disclaimer, the term of this patent is extended or adjusted under 35 U.S.C. 154(b) by 1087 days.

(21) Appl. No.: 11/555,387

(22) Filed: Nov. 1, 2006

(65) Prior Publication Data

US 2008/0163636 A1 Jul. 10, 2008

(51) Int. Cl.

| | |
|---|---|
| ***F25D 19/00*** | (2006.01) |
| ***F24F 1/50*** | (2011.01) |
| ***F24F 13/24*** | (2006.01) |
| ***F24F 1/40*** | (2011.01) |

(52) U.S. Cl.

CPC . *F24F 13/24* (2013.01); *F24F 1/50* (2013.01); *F24F 1/40* (2013.01)

USPC ..... 62/296; 62/509

(58) Field of Classification Search

CPC ..... F24F 1/40; F24F 13/24; F24F 1/50

USPC ..... 62/507, 296, 259.1, 263; 165/16, 122; 454/1, 42, 16

See application file for complete search history.

(56) References Cited

U.S. PATENT DOCUMENTS

| | | | | |
|---|---|---|---|---|
| 2,401,890 | A * | 6/1946 | Smith et al. | 62/325 |
| 3,242,345 | A * | 3/1966 | Kimura et al. | 290/2 |
| 4,528,005 | A * | 7/1985 | Baxter | 96/178 |
| 5,425,413 | A * | 6/1995 | Miliaras | 165/122 |
| 7,047,760 | B1 * | 5/2006 | Holman, Jr. | 62/428 |
| 2005/0016197 | A1 * | 1/2005 | Bourne et al. | 62/310 |

* cited by examiner

*Primary Examiner* — Mohammad M Ali

(57) ABSTRACT

A turbulence creating energy saving device which is installed on top of the air conditioner or refrigeration condenser or cooling tower. The device directs the hot air leaving the condenser or cooling tower straight up forcing the hot airflow through a series of fixed blades, causing the air to spiral creating a turbulence, thereby increasing the amount of air flowing through the cylindrical tube, in turn moving a larger amount of air through the condenser. The top of the device has a cowling with a reduced output diameter to reduce the output noise level. By adding the device to the top of the condenser or cooling tower the airflow is greatly improved, reducing the time to cool the unit, therefore a reduction in the use of hydroelectricity and extending the life expectancy and provides ability to save money.

7 Claims, 2 Drawing Sheets

COWLING

FIG. 3.1

TUBE

FIG. 3.2

FIXED BLADES

FIG. 3.3

AIR CONDITIONER TURBULENCE CREATING ENERGY SAVER

BACKGROUND OF THE INVENTION

1. Field of the Invention

This invention relates generally to air conditioning and refrigeration systems and more particularly to a device installed over the condenser unit or cooling tower that creates turbulence which increases the airflow dynamics, thereby removing more heat from the condenser or cooling tower, thus making the air conditioner or refrigeration system more energy efficient.

2. Description of the Prior Art

Prior art relating to air conditioning and refrigeration energy saving devices that improve the airflow dynamics through the condenser unit or cooling tower have not been invented.

Current designs for the condenser units or cooling towers do not allow for maximum airflow through the units therefore are wasting energy and causing damage to the environment.

By adding the energy saving turbulence creating device to the top of the condenser unit or cooling tower, its heat removing capabilities are greatly improved therefore reducing the impact on the environment by lessening the use of hydro electricity and increasing the life span of the condenser units which reduces the amount of garbage going to landfill sites.

Inventors are aware of U.S. Pat. No. 6,701,964, vortex generating airfoil fuel saver. This device is used for automobile air intake to increase the airflow to allow for a better fuel—air mixture which in turn results in better fuel economy.

Inventors are also aware of U.S. Pat. No. 4,310,028, an apparatus that increases the fluid throughput of a conduit. The fluid throughput of a conduit is increased without increasing the power requirements or the size of the conduit by affixing an airfoil to the inside of the conduit.

BRIEF DESCRIPTION OF THE DRAWINGS

These and other details of my invention will be described in connection with the accompanying drawings, which are furnished only by way of illustration and not in limitation of the invention, and in which drawings:

FIG. 3.1 the Cowling; used for noise suppression.

FIG. 3.2 the Tube; used for directing the hot airflow.

FIG. 3.3 the Fixed Blades; used to create turbulence.

DETAILED DESCRIPTION OF THE PREFERRED EMBODIMENTS

The embodiment of this invention provides a turbulence creating energy saving and noise reducing device which is installed onto the condenser unit or cooling tower of an air conditioner or refrigeration system.

Figure 1:
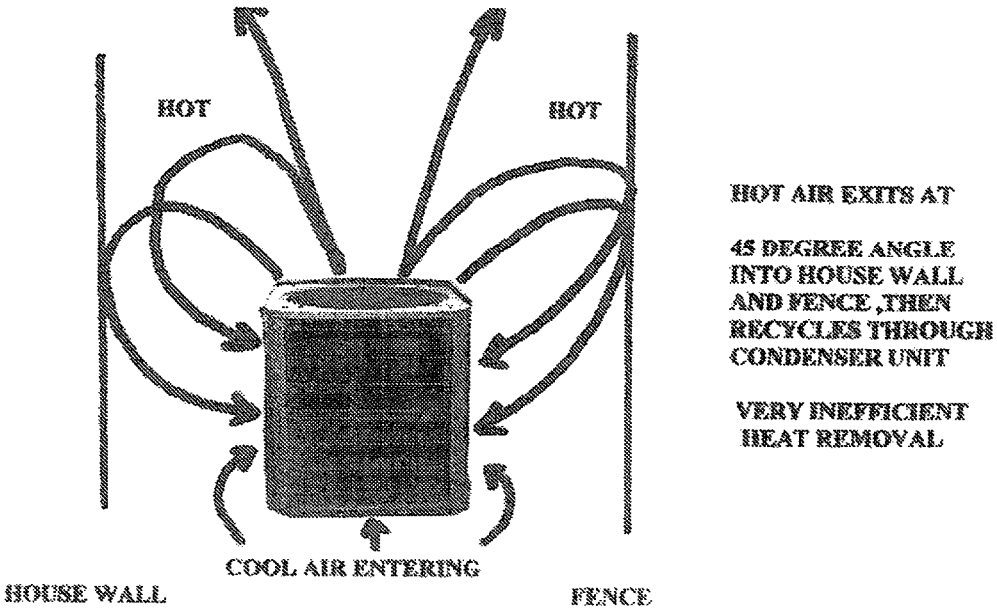
FIG. 1 PRIOR ART
FIG. 1 is a front elevation view of an air conditioning condenser before the device is installed as prior art and demonstrates the mixing hot and cold airflow.

As shown in FIG. 1, the condenser unit which is typically placed close to a wall, fence or other obstruction, causes the exhausting hot air to collide with the obstructions and forces the hot air to recirculate through the condenser, thereby significantly reducing its efficiency to remove heat.

Figure 2:
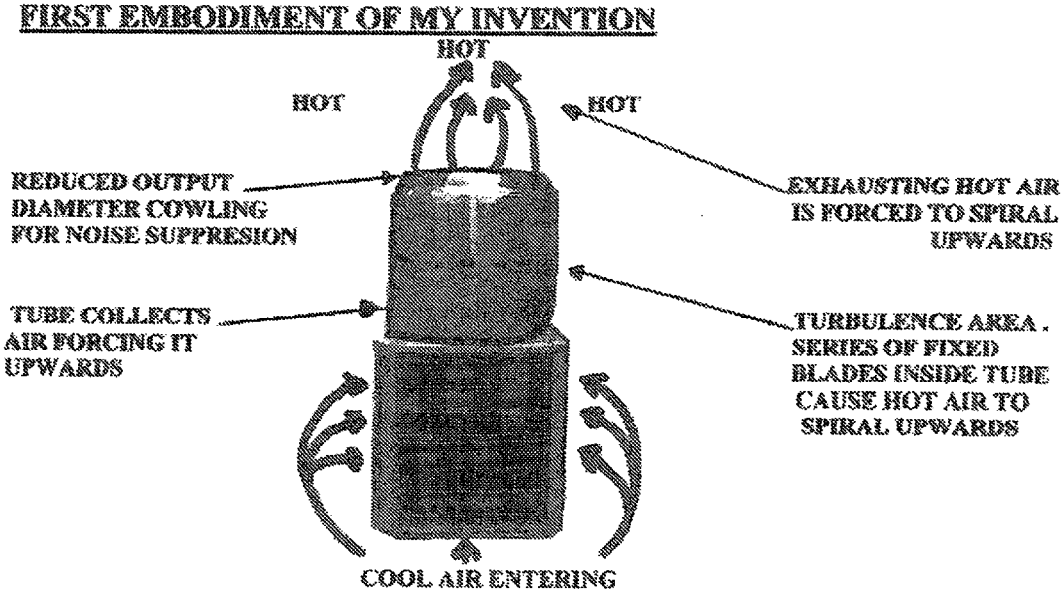
FIG. 2 is a front elevation view of an air-conditioning condenser after the device has been installed as first embodiment of present invention and demonstrates the improved airflow pattern.

In FIG. 2, the device is installed on top of a typical residential air conditioning condenser. With the device attached to the top of the condenser the exhausting hot air is forced upwards through the TUBE, then into a series of FIXED BLADES that cause the hot air to spiral up through the top of the TUBE then out the COWLING, which has a reduced output diameter that compresses the air flow and assists in noise suppression.

Figure 3:
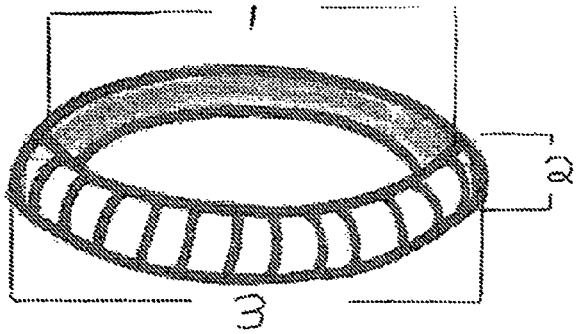
FIG. 3 is a perspective view of the invention of FIG. 2 showing the (3) three main components that comprise.
Figure 3:
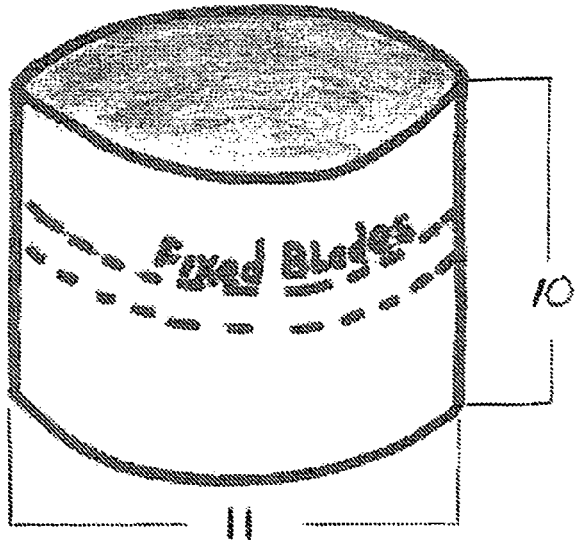
Figure 3:
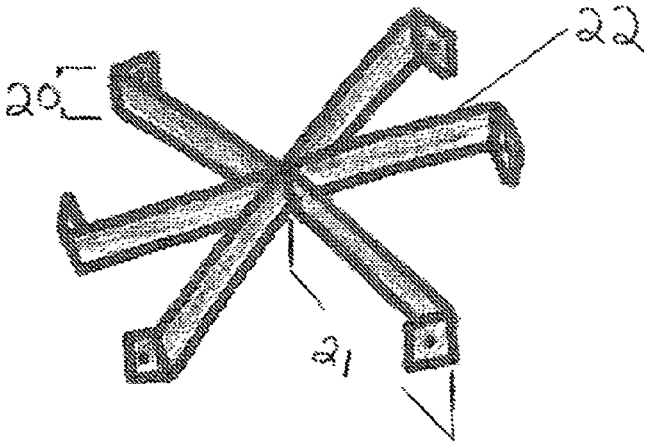

FIG. 3 is a drawing of the device, that shows the 3 main components which comprise;

FIG. 3A COWLING

FIG. 3B TUBE

FIG. 3C FIXED-BLADES

The device of FIG. 3B, the TUBE, is manufactured in various widths and heights to accommodate the various sizes of condenser output fans.

The height of the tube 10, varies from 1 inch to 30 feet and the width 11, varies from 1 inch to 100 feet.

The device of FIG. 3C the FIXED BLADES, are manufactured in various widths and heights to accommodate the various tube sizes, FIG. 3B.

The height of the blade 20, varies from 1 inch to 10 feet, the length of a blade 21, is half the width of the tube, the angle of the blade 22, varies from 3 to 87 degrees.

The device of FIG. 3A the COWLING, are manufactured in various widths and heights to accommodate the tube sizes. The output diameter 1, is reduced in width compared to the cowling input 3. The input of the cowling 3, equals the output diameter of the tube. The height 2, varies from 1 inch to 5 feet.

It is understood that various modifications may be made without departing from the spirit and scope of the invention.

SUMMARY OF THE INVENTION

An object of this invention is to provide a device that uses a series of fixed blades attached to the interior of a tube, mounted on top of the air conditioning or refrigeration condenser, causing air turbulence, therefore increasing the air flow through it to make it more energy efficient.

Another object of this invention is to have a cowling with a reduced output diameter, attached to the upper most section of the tube, to reduce the output noise level of the condenser unit An object of the present invention is to provide a device that improves energy efficiency in order to reduce environmental impact caused by the use of hydroelectric, nuclear, and coal burning facilities.

Another object of this invention is to make older air conditioners and refrigeration systems run more efficiently therefore the units will cool the same area in less time, less time will equal longer life for the air conditioner, thereby reducing the number of units going to a landfill site.

A further object of this invention is to have this design incorporated on all new air conditioning and refrigeration condenser units and cooling towers, residential, commercial, industrial and marine.

One more object of the present invention is to provide a screw on bracket which can be easily installed onto the condenser unit to hold the device in place.

The invention claimed is:

1. A turbulence creating energy saving device for an air conditioning or refrigeration condenser unit or cooling tower, the device comprising:

a cylindrical tube, a plurality of fixed blades attached to the cylindrical tube, an upper cowling attached on the top of the cylindrical tube;

wherein the device is installed directly over a cooling tower fan or condenser fan so as to capture all of the hot air exiting the cooling tower or condenser, then directing the air upward through the cylindrical tube, then into a plurality of fixed blades that are set at a 3 to 87 degree angle, with the blade tips set at a 60 to 90 degree angle, causing the passing airflow to spiral and create a turbulence upward then exiting device through the upper cowling consisting of a reduced output diameter, designed to compress the exhausting hot air and aid in the suppression of condenser fan noise.

2. The device of claim 1 wherein the turbulence creating energy saving and noise reducing device is manufactured in varying widths and heights so as to cover the output fan of units of various sizes.

3. The device of claim 2 wherein the series of blades are capable of handling temperatures ranging from minus 40 to plus 40 degrees Celsius.

4. The device of claim 3 wherein the device is fabricated of plastic, composite, metal, or a combination of these materials.

5. An air conditioning unit incorporating a turbulence creating energy saving device, the device comprising:

a cylindrical tube;

a plurality of fixed blades attached to the cylindrical tube;

an upper cowling attached on the top of the cylindrical tube;

wherein the device is installed directly over an air conditioning unit fan or so as to capture all of the hot air exiting the cooling air conditioning unit, then directing the air upward through the cylindrical tube, then into a plurality of fixed blades that are set at a 3 to 87 degree angle, with the blade tips set at a 60 to 90 degree angle, causing the passing airflow to spiral and create a turbulence upward then exiting the device through the upper cowling consisting of a reduced output diameter, designed to compress the exhausting hot air and aid in the suppression of condenser fan noise.

6. A refrigeration condenser unit comprising a turbulence creating energy saving device, the device comprising:

a cylindrical tube;

a plurality of fixed blades attached to the cylindrical tube;

an upper cowling attached on the top of the cylindrical tube;

wherein the device is installed directly over a condenser fan so as to capture all of the hot air exiting the refrigeration condenser unit, then directing the air upward through the cylindrical tube, then Into a plurality of fixed blades that are set at a 3 to 87 degree angle, with the blade tips set at a 60 to 90 degree angle, causing the passing airflow to spiral and create a turbulence upward then exiting the device through the upper cowling.

7. A cooling tower comprising a turbulence creating energy saving device, the device comprising:

a cylindrical tube;

a plurality of fixed blades attached to the cylindrical tube;

an upper cowling attached on the top of the cylindrical tube;

wherein the device is installed directly over a cooling tower fan so as to capture all of the hot air exiting the cooling tower, then directing the air upward through the cylindrical tube, then into a plurality of fixed blades that are set at a 3 to 87 degree angles, with the blade tips set at a 60 to 90 degree angle, causing the passing airflow to spiral and create a turbulence upward then exiting the device through the upper cowling consisting of a reduced output diameter, designed to compress the exhausting hot air and aid in the suppression of condenser fan noise.

* * * * *